United States Patent [19]

Thomas et al.

[11] Patent Number: 4,671,154

[45] Date of Patent: Jun. 9, 1987

[54] KNIFE CYLINDER FOR PROCESSING A CONTINUOUS WEB

[75] Inventors: Hermann Thomas, Darmstadt; Josef Herd, Münster; Hans Jakob, Darmstadt-Eberstadt, all of Fed. Rep. of Germany

[73] Assignee: Maschinenfabrik Goebel GmbH, Darmstadt, Fed. Rep. of Germany

[21] Appl. No.: 836,555

[22] Filed: Mar. 6, 1986

[30] Foreign Application Priority Data

Mar. 6, 1985 [DE] Fed. Rep. of Germany ..... 3507929

[51] Int. Cl.[4] ..... B26D 1/12; B26F 1/20

[52] U.S. Cl. ..... 83/698; 144/174

[58] Field of Search ..... 83/698, 346, 699; 144/174, 130, 230

[56] References Cited

U.S. PATENT DOCUMENTS

| | | | |
|---|---|---|---|
| 2,682,306 | 6/1954 | Schriber . | |
| 3,014,511 | 12/1961 | Kirsten | 144/230 |
| 3,171,454 | 3/1965 | Boice | 144/130 X |
| 3,793,918 | 2/1974 | Huffman | 83/698 |
| 4,055,101 | 10/1977 | Collins | 83/660 |
| 4,594,928 | 6/1986 | Thomas | 83/698 |
| 4,604,931 | 8/1986 | Bastian | 83/698 |

FOREIGN PATENT DOCUMENTS 2021061 11/1971 Fed. Rep. of Germany .

*Primary Examiner*—Jimmy C. Peters

*Attorney, Agent, or Firm*—Watson, Cole, Grindle & Watson

[57] ABSTRACT

A knife cylinder for processing a continuous web has a plurality of knife blades mounted therein by metallic bellows cylinders located in grooves which receive the knife blades. At least one force transmission element is likewise located in each groove between the blade and the bellows cylinders, or between the bellows cylinders and an opposing wall of the groove. Such elements contain pressure medium passageways connected with a pressure medium generating assembly for internally pressurizing the bellows.

9 Claims, 10 Drawing Figures

KNIFE CYLINDER FOR PROCESSING A CONTINUOUS WEB

RELATED APPLICATION

This application relates to U.S. Application Ser. No. 575,295, commonly owned herewith.

BACKGROUND OF THE INVENTION

This invention relates to a knife cylinder for processing a continuous web such as paper, synthetic or metal foil, fabric, or the like, the cylinder being rotatable on a machine frame and having at least one open groove formed in a cylindrical portion thereof for receiving and positioning at least one knife blade substantially parallel to the axis of rotation, a plurality of pressure medium cylinders distributed over the length of the knife blade for pressing it against the knife cylinder, the cylinders comprising metallic bellows cylinders capable of expansion and contraction in an axial direction thereof and being located within the groove perpendicular to the knife blade. A force transmission element is located between the blade and the bellows cylinders, and a pressure medium generating assembly is connected to the knife cylinder for rotation therewith, such assembly including a pressure generator for pressurizing the bellows cylinders, and pressure conduits communicating with the pressure generator for transmitting pressure medium from the pressure generator to each of the bellows cylinders.

Knife cylinders for processing a continuous web may have a knife blade or blades with discontinuous knife edges for imparting cross preparations to the web. Otherwise, the knife blades may have continuous edges for cross cutting through the web to produce sheets. The perforation or cutting lines are normally disposed perpendicular to the direction of travel of the web, although they may be positioned obliquely to such direction.

Generally, the knife blades are removably mounted in the knife cylinder such that dulled blades can be replaced without the entire knife cylinder having to be removed from the processing machine, for example, a form printing machine. At least one knife blade is attached to each cylinder, although usually several blades are provided equally spaced about the circumference of the knife cylinder for cross cutting or perforating the web into predetermined equal lengths.

In order for the knife blades to be effective in the desired manner, they must be set in relation to the web being processed, and/or in relation to a pressure cylinder opposing the knife cylinder. Thus, the knife blades must be securely fastened, in a removal manner, to the knife cylinder so as to avoid any shifting out of alignment, but be capable of easy removal. However, when worn knife blades are replaced, the forms printing machine and any other forms processing machine operating together therewith, must normally be stopped. The stopping of the machine necessarily results in a loss of production corresponding to the machine downtime. It is therefore desirable for the knife blades to be replaced in as short a time as possible.

An apparatus of the general type aforedescribed is disclosed in the related application Ser. No. 575,295, the entirety of the disclosure of which is hereby specifically incorporated by reference.

U.S. Pat. No. 2,682,306 discloses a tab cutter in which each cutting blade is attached to the knife cylinder by a plurality of screw fasteners which must each be loosened and tightened during blade removal and replacement, which is a long and tedious operation requiring rather extensive downtime for the machine. Moreover, each blade must be individually loosened during blade replacement, and each new knife blade must be attached individually to the rotatable knife cylinder. As a result, the time required for replacing the blades is even greater.

West German published application No. 20 21 061 discloses a knife cylinder in which the knife blades are mounted in place by the provision of an inflatable hose seated within correspondingly shaped surfaces of the cylinder. However, the knife blades cannot be firmly set in place. And, even with the provision of a firm hose, increased pressure must be applied to inflate the hose, such that only a relatively reduced pressure is available for bracing the blade. Moreover, since the hose is pressurized from its interior, an elastic hose would exert such pressure against the surrounding machine parts that it may yield or distort as the result of the high pressure to which it is subjected. The hose cover could therefore extend into the moving parts of the machine thereby causing a rapid deterioration of the cover and possibly resulting in hose rupture making it unsuitable for the purpose intended.

SUMMARY OF THE INVENTION

It is therefore an object of the present invention to provide a knife cylinder for processing a continuous web, at least one knife blade being removably and securely mounted on the cylinder for easy and rapid replacement while avoiding the drawbacks of prior art knife cylinders of this type, and which knife cylinder can be more easily and economically produced than before with fewer and less complicated parts.

In accordance with this objective, a cylindrical surface portion of the knife cylinder has at least one open groove formed therein for receiving and positioning at least one knife blade substantially parallel to the axis of rotation of the knife cylinder, and a plurality of pressure medium cylinders are distributed over the length of the knife blade for pressing the blade against the knife cylinder, the pressure medium cylinders comprising metallic bellows cylinders capable of expansion or contraction in an axial direction thereof, and being located within the groove and lying prependicular to the knife blade. These bellows cylinders may comprise what are known as metal bellows, membrane bellows or miniature bellows. A force transmission element is located between the blade and the bellows cylinders which may be operatively connected to such element, or to another force transmission element which bears against an opposite side wall of the groove. Thus, the bellows cylinders may bear against either such opposite side wall, or against such another force transmission element to which they are operatively connected.

And, a portion of a pressure conduit system may be located in one of the force transmission elements, and these elements may have outer side walls of arcuate shape lying in the cylindrical surface of the knife cylinder.

The knife blade bears against a side wall of the groove which lies in a radial plane relative to the axis of rotation of the knife cylinder thereby simplifying the construction of the knife cylinder and rendering it more economical to produce since other grooves otherwise required for communication with the knife groove as in prior art knife cylinders, are not required. For example, those other grooves required in the aforementioned related application for accommodating a moveable pressure lever, are avoided, as are additional grooves of U.S. Pat. No. 2,682,306 for the threaded fasteners. Instead, the advantages of known metal bellows are employed for firmly and removably bracing the cross cutting and/or cross perforating knife blades.

In accordance with the invention, the blades may be prebraced under relatively low pressure so that they may be set precisely relative to the opposing pressure cylinder by rotating the knife cylinder and the pressure cylinder, so as to thereafter brace the blades for operation into a firm lock such that they cannot slip relative to the knife cylinder or the pressure cylinder during the web cutting or web perforating operation. Moreover, all the blades on the knife cylinder may be braced at one time, or less than all such blades may be so braced or replaced without excessive downtime of the machine, thereby saving production time and costs.

Other objects, advantages and novel features of the invention will become more apparent from the following detailed description of the invention when taken in conjunction with the accompanying drawings.

DETAILED DESCRIPTION OF THE INVENTION

Various machine parts not essential for describing the present invention are eliminated from the drawings for the sake of clarity.

Figure 1:
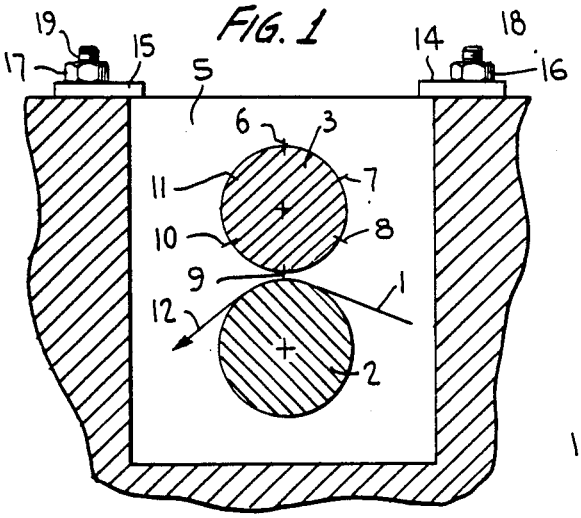
FIG. 1 is a schematic illustration of a knife cylinder and opposing pressure cylinder mounted in a machine for cross cutting or cross perforating a continuous web, according to the invention, and shown partially in cross-section.

As shown in FIG. 1, a web 1 of paper, plastic, metal, foil, fabric or the like extends partially about a pressure cylinder 2, and is fed through a gap formed between the pressure cylinder and a knife cylinder 3. The cylinders are journaled at opposite ends by suitable bearings 4 (FIG. 9) in machine frame parts 5 for rotation about the central axes of the cylinders. At least one of the cylinders is driven, and both are coupled together by gears, gear belts, etc., in such a manner as to rotate in a fixed phase relative to one another. As usual, one of the cylinders is driven by suitable drive means (not shown), which in turn drives the other cylinder.

Figure 2:
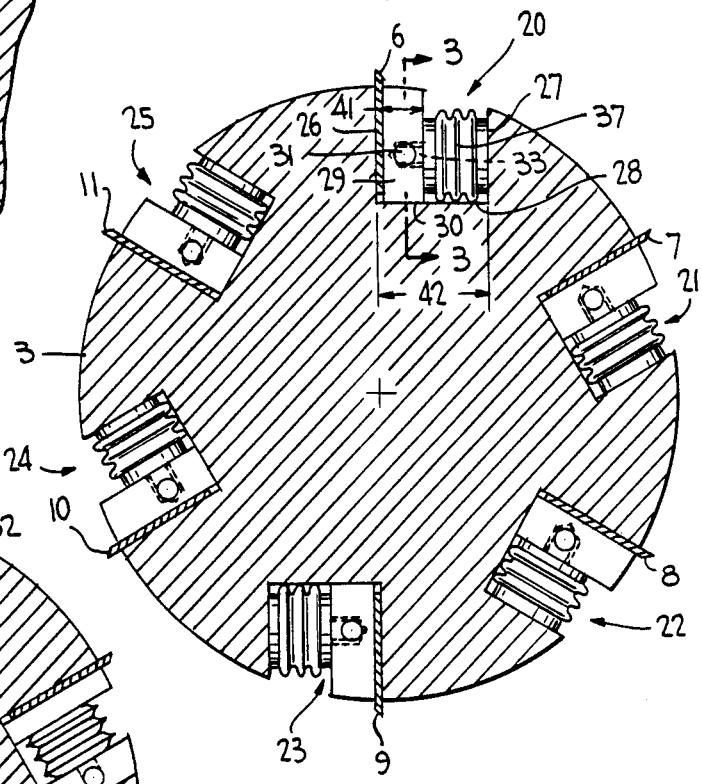
FIG. 2 is a sectional view, at enlarged scale, of the knife cylinder with the knife blade shown securely mounted in place in accordance with one embodiment of the invention.

As shown in FIG. 2, knife blades 6, 7, 8, 9, 10 and 11 are mounted on knife cylinder 3. Each blade may be the same, and is similarly mounted in place, so that the mounting of only blade 6 will be described in detail. The knife blades extend radially of the knife cylinder, and are shown lying parallel to the central rotatable axis of the knife cylinder, although the blades may otherwise lie obliquely thereto. And, the knife blades may either have a continuous cutting edge or a discontinuous cutting edge for respectively completely cutting through or perforating the continuous moving web. Thus, the web may be either cut into individual sheets, or may be cross perforated to produce tear lines for the individual sheets or fold lines along which the sheets may be fan folded.

The knife blades are equally spaced about the circumference of the knife cylinder, although fewer or less than the number of blades shown may be employed, and may be unequally spaced about the circumference of the knife cylinder. The number of grooves formed in the cylindrical surface of the knife cylinder corresponds normally to the number of knife blades to be mounted to the cylinder. However, less than all the grooves may be occupied by knife blades for a given operation as dictated by the requirements of the web processing production.

Knife cylinder 3 and the opposing pressure cylinder 2 are journaled at opposite ends to frame parts 5 which may be removable from main frame 13 of the machine and replaced by a similar unit. For this purpose, each frame part 5 is secured in place by the provision of clamping shoes 14 and 15, nuts 16 and 17, and bolts 18 and 19 which are secured to the main frame. Otherwise, frame parts 5 can be eliminated and cylinders 2,3 can be journaled directly to machine frame 13.

As shown in FIG. 2, knife cylinder 3 has six open grooves 20, 21, 22, 23, 24 and 25 formed at the circumference thereof each for receiving and positioning a knife blade. Each of the grooves has a side wall 26 which lies in a radial plane relative to the axis of a knife cylinder, the knife blade bearing flatly against this side wall and extending partially outwardly of the cylinder circumference. Each groove also has an opposing side wall 27 parallel to wall 26, and a bottom wall 28 extending between the side walls and perpendicular thereto.

Figure 3:
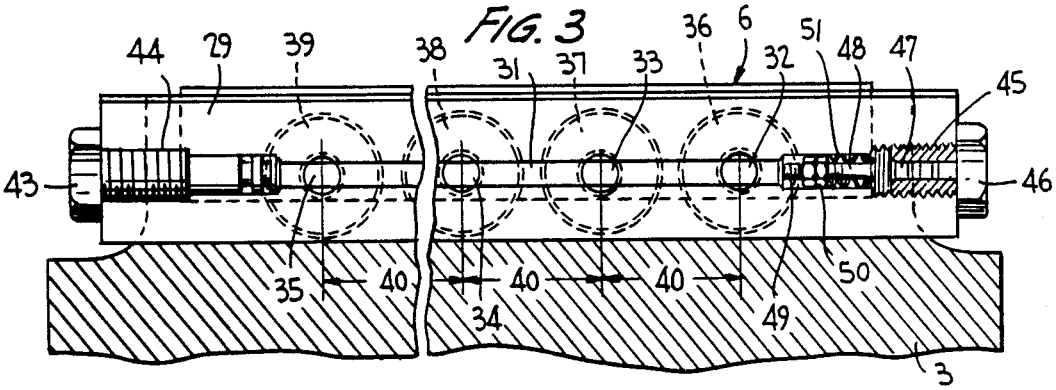
FIG. 3 is a sectional view taken substantially along the lines 3—3 of FIGS. 2, 4, 5, and 6.

Each of the grooves opens outwardly of the knife cylinder, and in the FIG. 2 embodiment, each contains a force transmission element 29 which bears against the knife blade. Inner side wall 30 of element 29 bears against bottom wall 28 of the groove. Each element 29 contains an elongated pressure medium passageway 31 extending between opposite ends of the element and which may be formed by drilling, the passageway lying parallel to bottom wall 28 and to inner wall 30. Additional pressure medium passageways 32, 33, 34 and 35, as shown in FIG. 3, are provided in each element 29 perpendicular to passageway 31 and intersecting therewith. And, each of the passageways 32–35 is internally threaded for threaded engagement with a hollow nipple or the like (not shown) of metallic bellows cylinders 36, 37, 38 and 39 for communicating the interior of each bellows cylinder with passageway 31. The bellows cylinders are distributed over the length of the knife blade at equally spaced distances 40 which correspond to the spacings of passageways 32–35. As can be seen, each distance 40 must be slightly greater than the diameter of a bellows cylinder.

Width 41 (FIG. 2) of each element 29 and width 42 of each groove are selected so that a commercially available bellows cylinder and force transmission element, threadedly interconnected, can be disposed within the groove such that the free ends of the bellows bear against side wall 27. In such manner, upon pressurizing bellows cylinders 36–39 associated with each blade, in a manner to be described hereinafter, the knife blade can be pressed tightly against side wall 26 with a sufficient force such that the knife blade will not dislodge or disorient during operation of the machine relative to wall 26 and thus the knife cylinder and the continuous web. The bellows cylinders permit application of a sufficiently high contact pressure transmitted to the blade, since the bellows cylinders, as known, are capable of expansion and contraction principally in an axial direction thereof. And, the bellows cylinders may be initially pressurized at lower pressures to permit prebracing so that the blades can be adjusted within their grooves at a relatively low rate of rotation of the knife cylinder, such that the blades can operate together optimally with the pressure cylinder. After such initial setting of the blades, a higher, operational pressure, is applied to the bellows cylinders so as to firmly press the knife blades against walls 26 during operation of the machine, in such a way as to be nondisplaceable.

Passageways 31–35 form a portion of a pressure conduit system which rotates together with the knife cylinder. This system has two openings by means of which it can be interconnected with a pressure medium introduced through one of such openings, and primed through the other opening. As shown in FIG. 3, one of such openings is closed by a threaded bolt 43 which threadedly engages internal threads 44. At the opposite end of passageway 31 internal threads 45 are provided with which a threaded bolt 46 engages. This bolt 46 has a coaxial opening 47 for sliding reception of a pressure piston 48. One end of this piston is threaded as at 49 for engagement by at least one nut 50. Springs 51 of any normal type extend between nut 50 and bolt 46.

Figure 9:
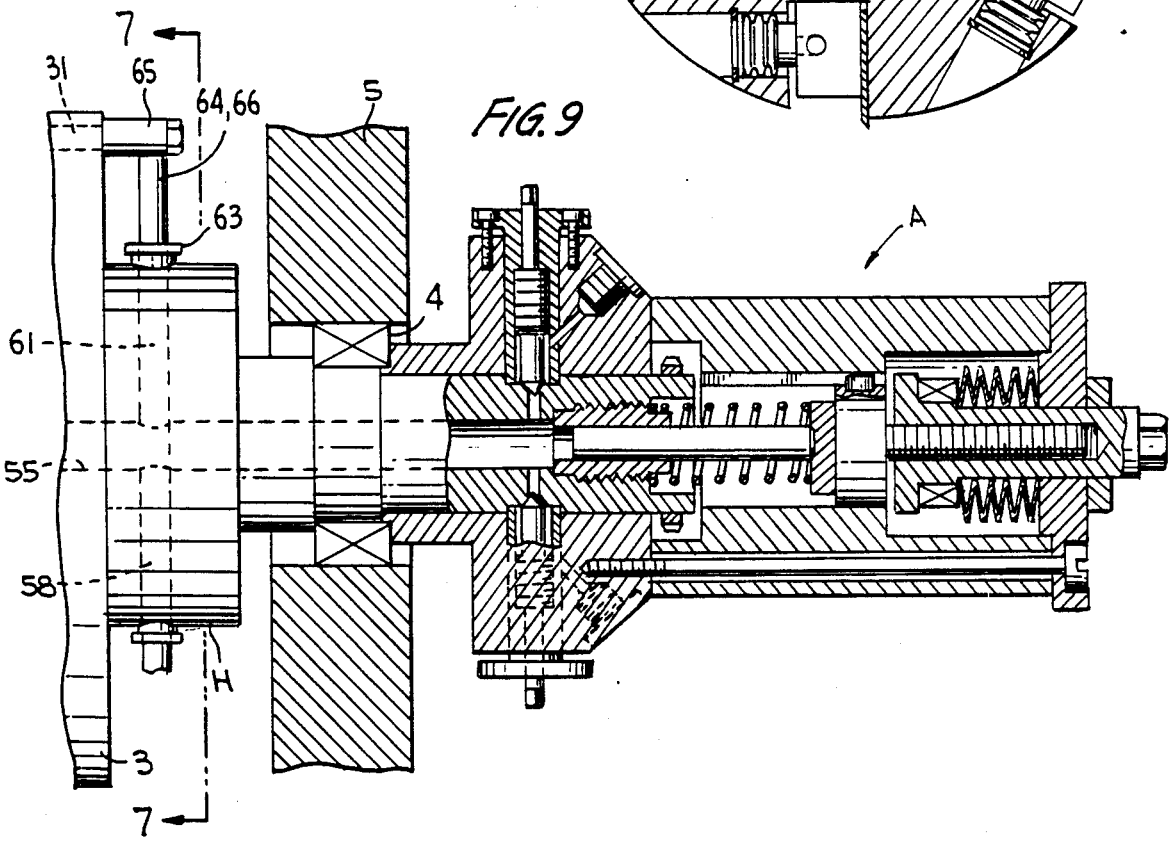
FIG. 9 is a section through a part of a pressure medium generating assembly for the knife blades of the knife cylinder.

During operation, bolt 46 is removed and connected with a pressure medium generating assembly A shown in FIG. 9, and bolt 43 is loosened so that on transmission of the pressure medium any air within conduits 31–35 is vented through this opposite end of passageway 31, until a sufficient pressure builds up in the conduit system. Bolt 43 may then be tightened and bolt 46 partially threaded so as to thereby exert a corresponding pressure to the conduit system, and correspondingly to the bellows cylinders. In such manner, a prebracing pressure may be generated for initially holding and setting the knife blades. Upon fully threading nut 46 inwardly, the pressure within the conduit system and correspondingly within the bellows cylinders is slightly increased sufficiently to press the knife blades against their confronting side walls 26 for securely mounting the knife blades in place.

Figure 5:
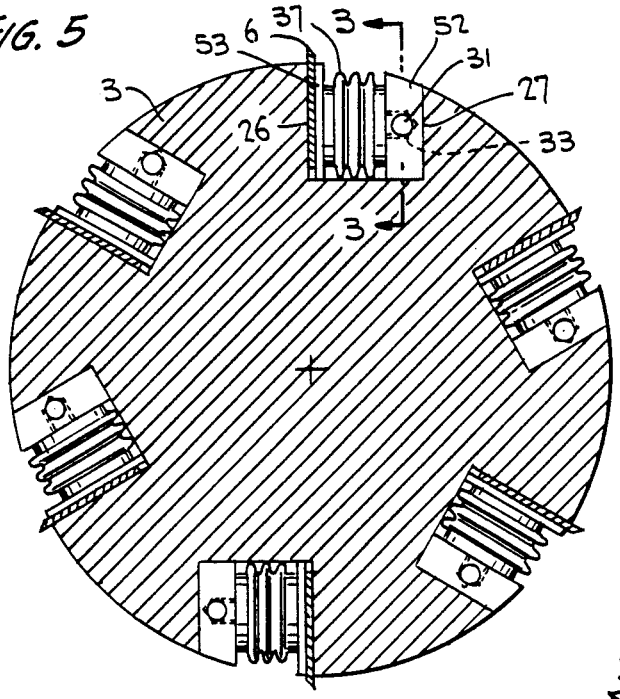

In the FIG. 5 embodiment, a force transmission element 52 is located within each of the grooves, this element bearing against opposed side wall 27 of the groove, and containing passageways 31–35. The bellows cylinders are coupled to element 52 so as to communicate with passageway 31 via passages 32–35, in the same manner as described with reference to FIG. 2.

And, a relatively thin force transmission element 53 is located between knife blade 26 and the metal bellows.

Figure 4:
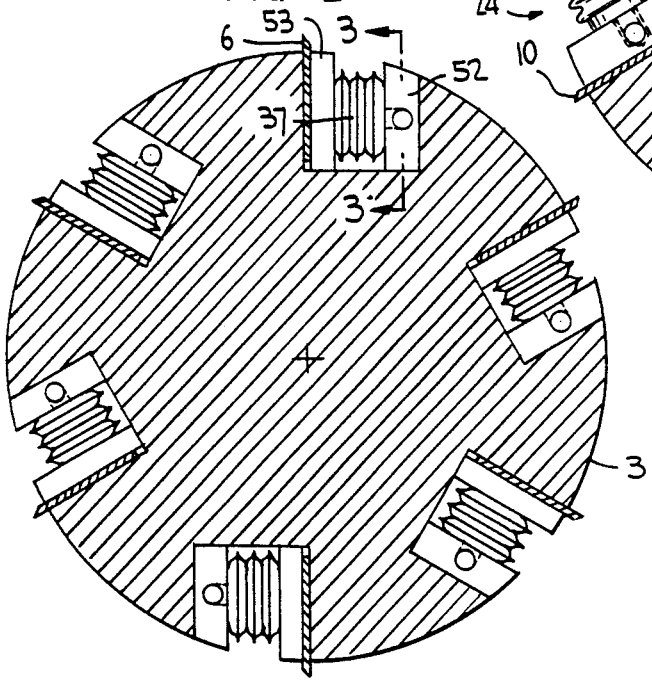
FIGS. 4, 5, 6 and 10 are views similar to FIG. 2 of other embodiments according to the invention.
Figure 6:
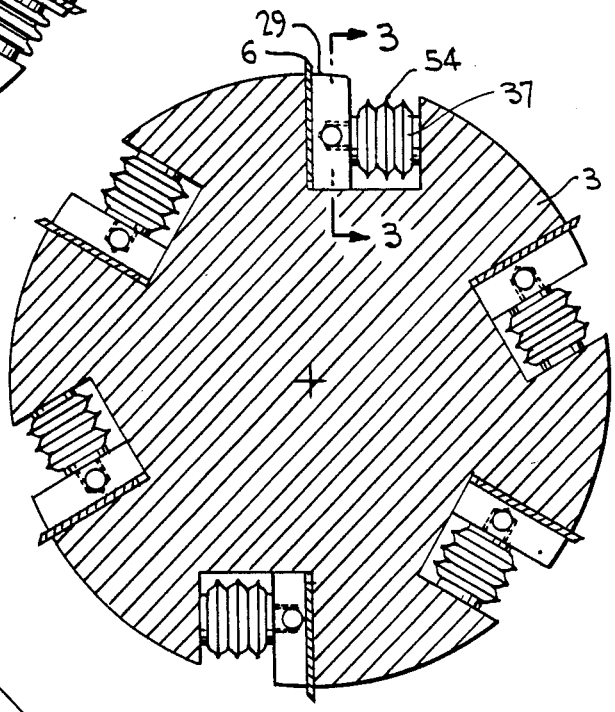

The FIG. 6 embodiment is essentially the same as that of FIG. 2, and the FIG. 4 embodiment is essentially the same as FIG. 5, except that bellows cylinders 37 are formed such that the individual bellows thereof form rather sharp external edges, and are welded together in pairs at such edges, i.e. at maximum external diameters 54 thereof. The bellows cylinders of FIGS. 4 and 6 are known as so-called membrane bellows, while the bellows cylinders of FIGS. 2 and 5 are known as so-called miniature bellows. Nevertheless, both types of bellows cylinders are metallic, can be single or multilayered, and may be of steel, aluminum, brass or other metals.

As seen from the aforedescribed, side wall 26 of each groove lies in a radial plane relative to the axis of rotation of the knife cylinder, and opposed side wall 27 lies parallel to wall 26.

As shown in FIG. 2 and 5, elements 29 and 52 are essentially trapezoidal in cross-section, the opposed side surfaces being essentially parallel, the inner side wall lying against the bottom wall of the groove, and the outer side wall being of arcuate shape so as to lie in the cylindrical surface portion of the knife cylinder. Thus, the outer side wall of each element 29 and 52 has a curvature equal to the radius of knife cylinder 3. Otherwise, the outer side walls of elements 29 and 52 may be planar, rather than arcuate, without departing from the invention.

FIG. 9 illustrates a pressure medium generating assembly, generally designated A, connected to the knife cylinder for rotation together therewith, and including a pressure generator for pressurizing the bellows cylinders. This assembly is described in detail in the aforementioned related application, and therefore need not be repeated here. As will be seen, this centrally disposed assembly A permits all the knife blades to be loosened, pre-braced or firmly braced simultaneously. A coaxial passage 55 is located in a hub H on the knife cylinder, and is in communication with the coaxial passage of assembly A, as shown. The hub likewise includes radial passages 56–61 (see also FIGS. 7,8) in communication with coaxial passage 55, and each of the radial passages has an enlarged external thread 62 at its outer end with which a pipe nut 63 threadedly engages. A connecting pipe 64 is supported by the pipe nut, and a pipe fitting 65 is mounted at the free end of the pipe for communicating each of the longitudinal passageways 31 of the force transmission elements with central passageway 55 via radial passageways 56–61, as essentially shown in FIG. 9. Therefore, upon operation of the pressure medium generating assembly, the bellows may be internally pressurized for pressing the knife blades firmly in place within their grooves.

Figure 7:
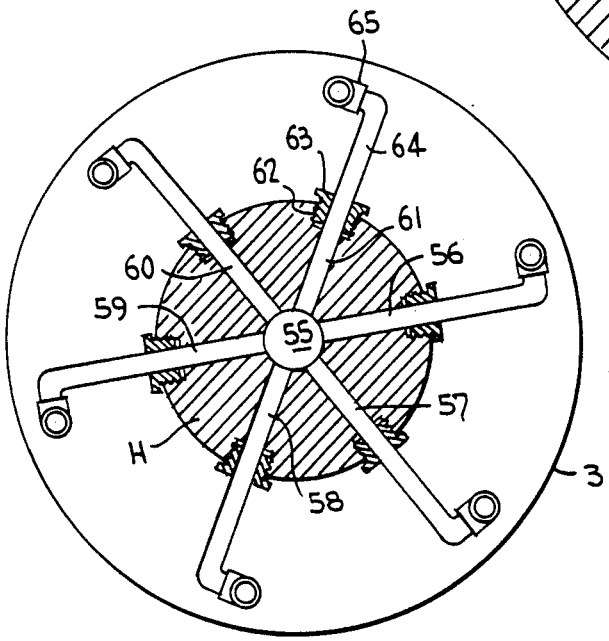
FIG. 7 is a view taken substantially along the line 7—7 of FIG. 9.
Figure 8:
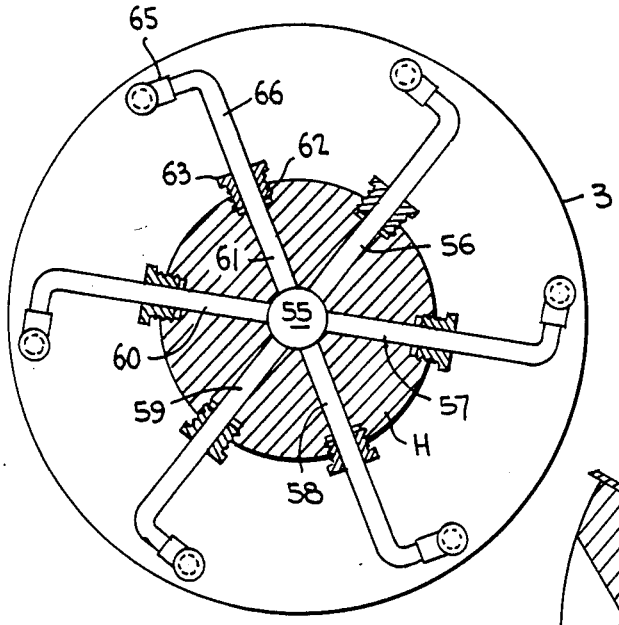
FIG. 8 is a view similar to FIG. 7 showing a slight modification.

The FIG. 8 arrangement is similar to that of the FIG. 7, except that the pipe conduits are especially adapted for communication with elongated passageways 31 of the FIGS. 4 and 5 embodiments.

Figure 10:
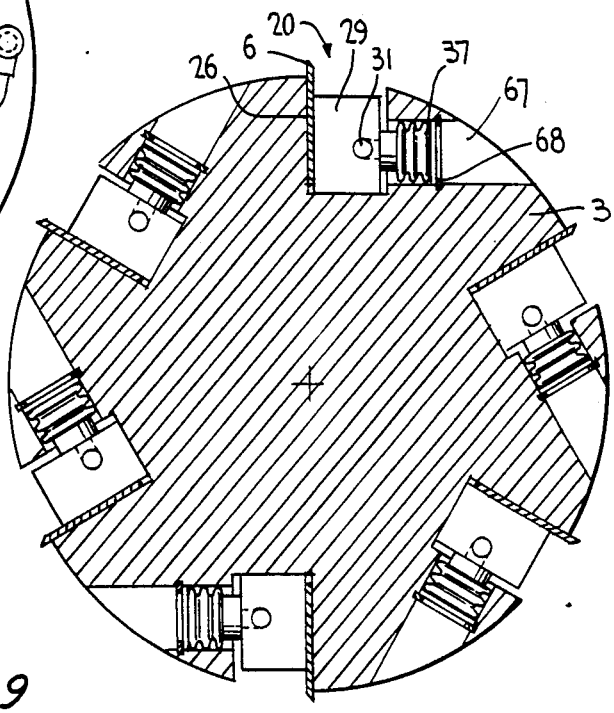

In the FIG. 10 arrangement, the knife cylinder is provided with open passages 67 coaxial with the bellows cylinders and opening into grooves 20–25, such that the bellows cylinders are coupled with force transmission element 29 upon insertion, externally of the knife cylinder, through passages 67. A safety ring 68 is located in each passage 67 for supporting an outer end of the bellows cylinder, such rings being received within annular grooves (not shown) in any normal manner.

The force transmission elements described above, and the connecting conduits 64 and 66, may be of metal, such as steel, aluminum, copper, or the like, and the pressure medium described may be hydraulic oil.

Obviously, many other modifications and variations of the present invention are made possible in the light of the above teachings. It is therefore to be understood that within the scope of the appended claims the invention may be practiced otherwise than as specifically described.

What is claimed is:

1. A knife cylinder for processing a continuous web, said cylinder being mountable on a machine frame for rotation about its axis of rotation, and comprising:

a cylindrical surface portion having at least one open groove formed therein for receiving and positioning at least one knife blade substantially parallel to said axis of rotation;

a plurality of pressure medium cylinders distributed over the length of said knife cylinder, said cylinders comprising metallic bellows cylinders capable of expansion and contraction in an axial direction thereof, said cylinders being located within said groove and lying perpendicular to said knife blade;

a first force transmission element located between said blade and said bellows cylinders;

a pressure medium generating assembly connected to said knife cylinder for rotation together therewith, said assembly including a pressure generator for pressurizing said bellows cylinders; and conduit means communicating with said pressure generator for transmitting pressure medium from said pressure generator to each of said bellows cylinders.

2. The knive cylinder according to claim 1, wherein said bellows cylinders are each connected to said force transmission element.

3. The knife cylinder according to claim 1, wherein said groove has a first side wall lying in a radial plane relative to said axis of rotation, an opposed side wall parallel to said first side wall, and a bottom wall interconnecting said side walls, said knife blade bearing against said first side wall, and said bellows cylinders having ends bearing against said opposed side wall.

4. The knife cylinder according to claim 1, wherein said groove has a first side wall lying in a radial plane relative to said axis of rotation, an opposed side wall parallel to said first side wall, and a bottom wall interconnecting said side walls, said knife blade bearing against said first side wall, a second force transmission element bearing against said opposed side wall, and said bellows cylinders having ends bearing against said second force transmission element.

5. The knife cylinder according to claim 1, wherein said bellows cylinders are operatively connected with said first force transmission element, and a portion of said conduit means being located within said first element.

6. The knife cylinder according to claim 1, wherein said bellows cylinders are operatively connected with said second force transmission element, and a portion of said conduit means being located within said second element.

7. The knife cylinder according to claim 1, wherein said groove has opposed side walls and an interconnecting bottom wall, said first force transmission element having an inner side wall bearing against said bottom wall, and having an opposed outer side wall of arcuate shape lying in said cylindrical surface portion.

8. The knife cylinder according to claim 1, wherein said second force transmission element has an inner side wall bearing against said bottom wall of said groove, and has an opposed outer side wall of arcuate shape lying in said cylindrical surface portion.

9. The knife cylinder according to claim 1, wherein said at least one groove comprises a plurality of grooves spaced over said cylindrical surface position and each for receiving and positioning a knife blade.

* * * * *